United States Patent [19]

Omori et al.

[11] Patent Number: 4,474,844

[45] Date of Patent: Oct. 2, 1984

[54] HEAT TRANSFER RECORDING MEDIUM

[75] Inventors: Takashi Omori; Haruhiko Moriguchi, both of Kanagawa; Tadao Seto, Chiba; Yoshikazu Shimazaki, Osaka; Hiromitsu Matsuba, Tokyo; Toshiharu Inui, Kanagawa, all of Japan

[73] Assignees: Fuji Xerox Co., Ltd.; Fuji Kagakushi Kogyo Co., Ltd., both of Japan

[21] Appl. No.: 451,224

[22] Filed: Dec. 20, 1982

[30] Foreign Application Priority Data

Dec. 24, 1981 [JP] Japan ..... 56-208196

[51] Int. Cl.[3] ..... B41M 5/26

[52] U.S. Cl. ..... 428/216; 428/200; 428/211; 428/409; 428/488.1; 428/537.1; 428/913; 428/914

[58] Field of Search ..... 428/195, 200, 204, 211, 428/488, 537, 913, 914, 207, 215, 216, 340–342, 409; 219/216; 346/76 PH

[56] References Cited

U.S. PATENT DOCUMENTS 3,453,648 7/1969 Stegena ..... 346/76 PH
3,596,055 7/1971 Elston ..... 346/76 PH

*Primary Examiner*—Bruce H. Hess
*Attorney, Agent, or Firm*—Sughrue, Mion, Zinn, Macpeak, and Seas

[57] ABSTRACT

A heat transfer recording medium which comprises tissue paper having thereon an ink layer comprised of material fluidizable or sublimatable upon the application of heat. The tissue paper has a thickness of 5 to 25 μm, a density of 0.8 to 1.45 g/cm$^3$, a smoothness of 200 to 20,000 seconds (determined by the Oken type measurement) and a water content adjusted to 6 to 13 wt % after forming the ink layer thereon. The medium does not generate puckers when employed in a transfer type heat sensitive recording apparatus under high temperature and humidity conditions.

6 Claims, 2 Drawing Figures

HEAT TRANSFER RECORDING MEDIUM

FIELD OF THE INVENTION

This invention relates to a heat transfer recording medium to be employed in a transfer type heat sensitive recording apparatus, and more particularly, to a heat transfer recording medium which does not generate puckers under a high temperature and humidity condition.

BACKGROUND OF THE INVENTION

Non-impact type recording apparatuses represented by heat sensitive recording apparatuses are advantageous because they do not produce much noise, compared with impact type recording apparatuses, and therefore do not deteriorate the office work environment. In one transfer type heat sensitive recording apparatus, an ink image is transferred onto a recording paper by applying heat pulses to a heat transfer recording medium comprised of a base material having thereon an ink layer capable of heat transfer. Therefore, in comparison with conventional recording apparatuses utilizing recording paper of the heat sensitive coloration type, apparatuses of the above-described type have greater advantages in that (1) plain paper can be employed as recording paper, and (2) since an ink layer is made up of a mixture of binding agent like waxes, which can be fluidized or sublimed by applied heat, with a pigment or a dye, not only is the ink image obtained excellent in clarity and fastness, but the color of the image to be formed can be freely controlled by selecting proper pigments or dyes.

The heat transfer recording medium as a whole is shaped like carbon paper or carbon ribbon and utilizes tissue paper excellent in thermal resistance and smoothness as a base material, as described in U.S. Pat. Nos. 2,917,996, 3,453,648 and 3,596,055. Conventional transfer type heat sensitive recording apparatuses are constructed such that a heat transfer recording medium is wound on a roll and continuously supplied to its recording position (called a supplying roll hereinafter). When a heat transfer recording medium is allowed to stand for a long time in such a transfer type heat sensitive recording apparatus at high temperature and humidity conditions, the base material expands by absorbing moisture. This expansion phenomenon occurs to a large extent in the part paid out of the supplying roll toward the recording position in the transfer type heat sensitive recording apparatus. The degree of expansion which takes place is not uniform. The heat transfer recording medium can absorb a large amount of moisture and expand unrestrictedly only in the part which is paid out of the supplying roll and thereby, comes into contact with the atmosphere. However, expansion is hindered with respect to parts which are in contact with and pressed by conveying rollers and like attachments. If the heat transfer recording medium is expanded nonuniformly, it will make waves upwards and downwards in the medium. In practice the parts waving upwards and downwards are frequently converted to "puckers" when heated by a thermal head in the recording region. In the event that the puckers are produced in the heat transfer recording medium, transfer of ink onto recording paper in the recording region can not be effected with a good result, and an ink image obtained is partially missing, creating blank spots. Such a phenomenon is responsible for disadvantages such as decreasing the quality of the image obtained, and/or a failure to reproduce essential image information.

SUMMARY OF THE INVENTION

Therefore, an object of this invention is to provide a heat transfer recording medium comprising a base material which does not produce puckers when used in connection with a transfer type heat sensitive recording apparatus.

The above-described object is attained by using as a base material tissue paper which has a thickness of 5 to 25 μm, a density of 0.8 to 1.45 g/cm$^3$ and a water content adjusted to 6 to 13 wt% after the formation of an ink layer thereon.

When the above-described tissue paper is employed as a base material, it is difficult for the waving phenomenon to occur in a heat sensitive recording medium even under high temperature and humidity conditions because the water content of the tissue paper is greater than those of conventionally used tissue papers. In addition, tissue paper has desirable stiffness, provided that it has a thickness and a density within the above-described ranges. Therefore, the waving and generation of puckers are reduced to a great extent.

DETAILED DESCRIPTION OF THE INVENTION

Figure 1:
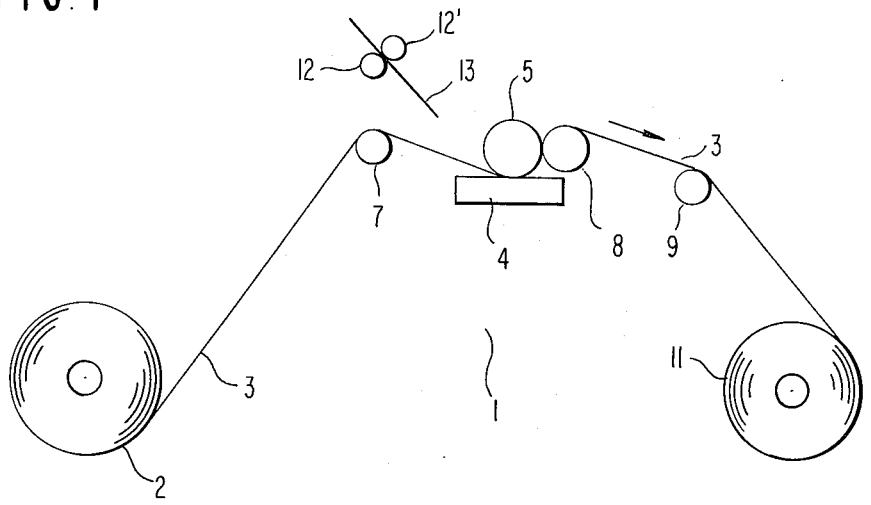
FIG. 1 is a schematic illustration of a transfer type heat sensitive recording apparatus.

A preferable thickness of the tissue paper to be employed in this invention ranges from 5 to 25 μm, particularly from 7 to 18 μm. When the tissue paper is thinner than the above-described range, it frequently happens that ink coated on tissue paper penetrates into the tissue paper and oozes out of the back side of the tissue paper. The ink which has oozed out stains the heat evolving face of a thermal head which is placed so as to be in contact with the back side of the tissue paper and rubbed therewith, resulting in deterioration of recording characteristics of the thermal head. In addition, the physical strength of the tissue paper decreases with a decrease in thickness and thereby, the probabilities of observing the waving phenomenon and generating puckers are increased.

When the thickness of the tissue paper is increased beyond the above-described range, heat from the thermal head is diffusively transmitted towards the ink layer. Therefore, not only is resolution lowered, but a large quantity of thermal energy is required for heat transfer recording and consequently, a large capacity electricity source and in its turn, a large-size apparatus is required. Further, the life span of the thermal head is shortened.

The density of the tissue paper preferably ranges from 0.8 to 1.45 g/cm$^3$, more particularly from 0.9 to 1.4 g/cm$^3$. If the density is below the above-described range, the tissue paper becomes porous and thereby, conduction of heat from the thermal head is hindered and efficient heat transfer recording becomes impossible. If the density is above the above-described range, and calendering is included in the manufacturing process of a base material, the calendering becomes difficult and must be carried out under very high pressure. Accordingly, unevenness in thickness, puckers or break may be created in the tissue paper obtained.

The water content of the tissue paper is so controlled as to be preferably 6 to 13 wt%, particularly 8 to 11 wt%, after the formation of an ink layer on the base material. If the water content of the base material is below the above-described range, if the material is placed under the circumstances of high temperature and humidity waving or puckers may be produced in the heat transfer recording medium. If the water content of the base material is beyond the above-described range, the strength of the base material decreases and breaks tends to occur, or coating unevenness tends to occur at the time of ink coating.

Further, it is desirable for tissue paper to have a smoothness of 200 to 20,000 seconds (measured using an Oken type smoothness and air resistance tester (of pressure applying system), that is, JAPAN TAPPI paper and pulp test No. 5, method B for testing smoothness and air resistance of paper and board using a pneumatic micrometer type tester). If the smoothness of the base material is below the above-described range, it is too low to create sufficiently close contact with a thermal head. Thereby, nonuniformity is generated in the transfer density of the ink image. In addition, a base material poor in smoothness is undesirable from the standpoint of coating an ink layer thereon, because if smoothness of the base material is high, an ink layer can be coated thereon in a thinner and more uniform manner. On the other hand, if the smoothness of a base material is increased beyond the above-described range, it becomes increasingly difficult to merely make the tissue paper, and recording characteristics of the paper in heat transfer recording are only slightly improved.

Tissue paper having a desired thickness, a desired density and a desired smoothness can be obtained by beating wood pulp to make a paper in dense formation uniform in both machine direction and cross direction, and subjecting the paper to a surface-smoothing treatment using a super calendering process. Tissue paper can also be made of chemical pulp such as kraft pulp and sulfate pulp. On this tissue paper there is formed an ink layer, which is one of conventionally used ink layers, and has a thermofluidizing or a thermosublimating property. The ink layer is formed using a conventional coating technique to produce the heat transfer recording medium of this invention.

The ink layer remains solid at ordinary temperature (20°-30° C.) and when it is heated to a certain temperature (50°-120° C.), its viscosity is decreased to liquify or sublime. Any conventional ink layer can be used for the purpose. In general, the ink layer comprises a binder, a coloring agent and a softening agent. Examples of the binder include waxes such as carnauba wax, ester wax, paraffin wax and rice wax. For the coloring agent, any coloring agent can be used, and those having good weatherability are preferred. Examples of the softening agent include oils such as caster oil, polyvinyl acetate, polystyrene, a styrene-butadiene copolymer, cellulose ester, cellulose ethers and acrylic resins. Other additives may be added to facilitate coating of the ink layer and improve storability of the recording medium, such as ethylene vinyl acetate. The formulation of ink layer is suitably determined taking into consideration the properties such as melting point, thermal conductivity, heat capacity, specific heat, heat of fusion, density, tensile strength, melt viscosity, etc.

The ink layer generally has a thickness of 2 to 15 μm, preferably 2 to 8 μm and more preferably 3 to 5 μm. If the ink layer has a thickness greater than 15 μm, a large quantity of thermal energy is required for fluidization or sublimation of the ink layer. In addition, a thick ink layer causes a decrease in resolution since heat diffuses inside the layer. Therefore, an ink layer thicker than 15 μm is disadvantageous. The ink layer is provided on tissue paper using a hot melt coating technique or a solvent coating technique. Thus, a heat transfer recording medium can be obtained.

In order to adjust the water content of the thus obtained heat transfer recording medium to 6 to 13 wt% with the ink layer formed thereon, a variety of methods can be employed. In one method, a large quantity of moisture is given to the tissue paper using some technique prior to the ink coating, and then the water content of the tissue paper is adjusted to 6 to 13 wt%. For example, the water content is adjusted at a relative high level (about 30 wt%) when making a paper and then reduced during a subsequent super calendering treatment, or the water content is minimized when making a paper and then increased during the super calendering treatment. It is also feasible to adopt a method whereby moisture is given to ink-coated tissue paper. In the latter method, the water content of the base material is increased to an optimum level by passing the heat transfer recording medium through a high humidity chamber, or by spraying water on the surface of the base material where the ink layer is not coated. It should be noted that the present invention is not to be restricted by the method of adjusting the water content.

The way in which a heat transfer recording medium is used for heat transfer recording in a transfer type heat sensitive recording apparatus is illustrated below. FIG. 1 shows an example of a transfer type heat sensitive recording apparatus. In the interior of the transfer type heat sensitive recording apparatus 1, a supplying roll 2 is set. The apparatus is designed so that the heat transfer recording medium 3 paid out of the supplying roll 2 is supplied to a recording part comprised of a thermal head 4 and a pressure applying roller 5. On this side of the recording part, a guide roller 7 for conducting the heat transfer recording medium 3 between the thermal head 4 and the pressure applying roller 5 is provided. Against the pressure applying roller 5, a drive roller 8 is pressed through the heat transfer recording medium 3. The drive roller 8 is devised so that it may rotate only for the duration of recording operation and within a prescribed period of time before and after the recording operation, and drive the rotation of the pressure applying roller 5 and at the same time, convey the heat transfer recording medium 3 in a direction indicated by an arrow (secondary scanning direction). The heat transfer recording medium 3 which has passed on the drive roller 8 is conducted to a winding roll 11 by means of a guide roller 9 and wound around the winding roll 11. The recording part is designed so that recording paper 13 may be supplied thereto from a supplying tray, which is not illustrated in the figures, by means of a pair of supplying rollers 12 and 12'.

When the above-described transfer type heat sensitive recording apparatus 1 is used for recording image information on recording paper 13 which belongs to Japanese Industrial Standards Rank A, Number 4 is taken as an example. Therein, a long sheet having a width of 220 mm, which is slightly wider than the width of the recording paper 13, is employed as the heat transfer recording medium 3 to be paid out of the supplying roll 2. As soon as the recording operation is started, the recording paper 13 arrives at the recording part by being conveyed by means of a pair of the supplying rollers 12 and 12'. When the front of the recording paper 13 reaches the area of the thermal head 4, a photosensor, which is not illustrated in the figure, detects it. The drive roller 8 is devised so that it is timed to start its rotation at the time of the detection, and the conveyance of the heat transfer recording medium 3 is started by this rotation of the drive roller 8. Under such a situation, the front of the recording paper 13 is inserted between the circumferential face of the pressure applying roller 5 and the upper surface (the ink layer side) of the heat transfer recording medium 3. Thereafter, the recording paper 13 is conveyed between the thermal head 4 and the pressure applying roller 5 in such a state that it is sandwitched between the above-described faces. The function of the pressure applying roller 5 is to press the heat transfer recording medium 3 and the recording paper 13, which are moving in the superposed condition, on the surfaces of exothermic elements of the thermal head 4 and therethrough, heat transfer recording can be effected.

Figure 2:
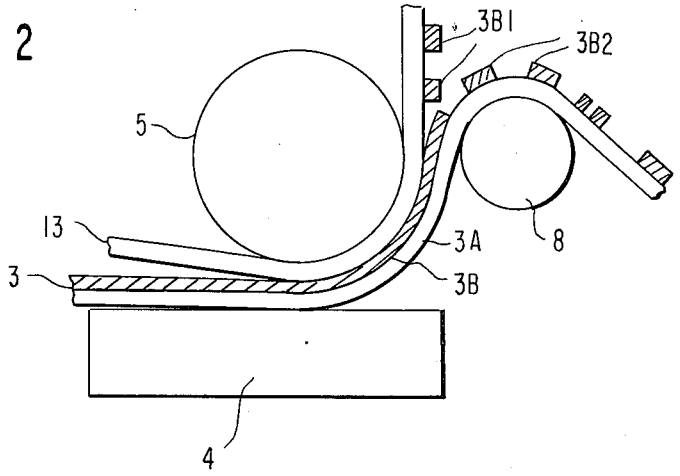
FIG. 2 is a schematic diagram in which the principle of the transfer type heat sensitive recording apparatus of FIG. 1 is illustrated magnifying the area of the recording part thereof, wherein numeral 3 designates a heat transfer recording medium, 3A tissue paper, and 3B an ink layer.

FIG. 2 is an illustration of the recording principle in the above-described apparatus. The thermal head 4 is fitted with a number of exothermic elements arranged in a line at its upper surface. These elements are designed to come into contact with the heat transfer recording medium 3. When the thermal head 4 is driven for each line by the method of Raster scanning exothermic elements evolve heat selectively corresponding to image information. At the points where exothermic elements evolve heat, thermal energy is conducted to the ink layer 3B through the tissue paper 3A and fluidizes or sublimates the ink present at the points where the thermal energy reaches. Some portion of the fluidized ink permeates into fibers of the recording paper 13, and solidifys therein as the temperature is lowered. The sublimated ink also gets into fibers of the recording paper 13, and solidifies therein when the temperature is decreased. When the heat transfer recording medium 3 is separated from the recording paper 13 at the time of passing on the drive roller 8, ink 3B1 which has once been fluidized or sublimated is transferred onto the side of the recording paper 13 because the tissue paper 3A has higher smoothness. On the other hand, ink 3B2 present in areas where heat has not reached remains on the tissue paper 3A as it is. As a result of the selective transfer of ink in the above-described manner, an ink image (recorded image) is formed on the recording paper 13. Since all the ink 3B1 present in the heated areas is transferred onto the recording paper 13, the ink image formed is clear and its resolution is high. In addition, there is no omission of ink from any part of the recorded image, because the heat transfer recording medium 3 does not produce any puckers. Moreover, as ink is infiltrated into parts of the fibers which make the recording paper 13, the ink image formed is excellent in fastness, and it is difficult to tamper with the ink image. That is, a recorded image which can withstand a long-range storage can be formed on plain paper.

This invention will now be illustrated in more detail by reference to the following examples and comparative example.

EXAMPLE 1

On one side of a base material having a thickness of 13 μm, a width of 220 mm, a density of 1.33 g/cm$^3$, smoothness of 15,000 seconds and a water content of 9 wt%, was coated heat fluidizable ink comprising the following proportions of ingredients to form an ink layer having a thickness of 5 μm. The water content of the base material after forming the ink layer was 8.5 wt%.

| Compounded Ingredient | Parts by Weight |
|---|---|
| Carbon Black | 20 |
| Carnauba Wax | 20 |
| Ester Wax | 40 |
| Oil | 20 |

EXAMPLE 2

A heat transfer recording medium was prepared using a base material having a thickness of 13 μm, a width of 220 mm, a density of 0.95 g/cm$^3$, smoothness of 6,000 seconds and a water content of 7 wt%, and the same ink as in Example 1. The water content of the base material after forming the ink layer was 6.7 wt%.

COMPARATIVE EXAMPLE

A heat transfer recording medium was prepared using a base material having a thickness of 13 μm, a density of 1.33 g/cm$^3$, smoothness of 15,000 seconds and a water content of 4 wt%, and the same ink as in Example 1. The water content of the base material after forming the ink layer was 3.8 wt%.

Each of the heat transfer recording media prepared in Examples 1 and 2, and Comparative Example was allowed to stand for 10 minutes under a temperature of 30° to 40° C. and a humidity of 80 to 95%. Thereafter, the waving phenomenon and generation of puckers were not found at all in the heat transfer recording media of Examples 1 and 2. On the other hand, a number of waves, which are linked with the generation of puckers, were generated in that of the Comparative Example.

The transfer type heat sensitive recording apparatus described above was fitted with each of the above-described heat transfer recording media, and allowed to stand for a while under the same circumstance. The recording operation was then repeated. Thereupon, no waves were generated in each of the heat transfer recording media of Examples 1 and 2 even in the areas in contact with the guide roller 7 and the pressure applying roller 5 illustrated in FIG. 1. Accordingly, a recorded image of high quality was obtained.

On the other hand, a number of puckers were generated in the heat transfer recording medium of the Comparative Example and therefore, satisfactory recording could not be effected.

As illustrated above, this invention relaxes restrictions on the environmental condition under which a heat transfer recording medium can be used by employing a base material which has a thickness, a density and a water content adjusted to within their respective prescribed ranges. Therefore, there is no need to take special measures to prevent moisture from coming into a transfer type heat sensitive recording apparatus, and a recorded image of excellent quality can always be obtained.

This invention should not be construed as being limited to the heat transfer recording medium having an ink layer only on one side of the tissue paper. The invention may include medium which have ink layers on both sides of tissue paper which are used for simultaneous recording on two sheets of paper or other purposes. Further, the heat transfer recording medium of this invention may include medium comprised of tissue paper coated on one side with a color forming agent for heat sensitive coloration recording and coated on the other side with the above-described ink layer for heat transfer recording.

While the invention has been described in detail and with reference to specific embodiment thereof, it will be apparent to one skilled in the art that various changes and modifications can be made therein without departing from the spirit and scope thereof.

What is claimed is:

1. A heat transfer recording medium, comprising:

a base material comprised of tissue paper having a thickness of 5 to 25 μm, a density of 0.8 to 1.45 g/cm$^3$; and an ink layer formed on a surface of the base material, the ink layer being comprised of material fluidizable or sublimatable upon the application of heat, wherein after the application of the ink layer to the base material, the water content of the base material was 6 to 13 wt%.

2. A heat transfer recording material as claimed in claim 1, wherein the base material has a smoothness of from 200 to 20,000 seconds determined by the Oken type measurement.

3. A heat transfer recording medium as claimed in claim 1, wherein the base material has a thickness within the range of from 7 to 18 μm.

4. A heat transfer recording medium as claimed in claim 1, wherein the base material has a density within the range of from 0.9 to 1.4 g/cm$^3$.

5. A heat transfer recording medium as claimed in claim 1, wherein the water content of the base material after the application of the ink layer is 8 to 11 wt%.

6. A heat transfer recording medium as claimed in claim 1, wherein the ink layer has a thickness of 2 to 15 μm.

* * * * *